US007722255B2

(12) United States Patent
Tessera Chiesa

(10) Patent No.: US 7,722,255 B2
(45) Date of Patent: May 25, 2010

(54) DEVICE FOR OPENING HERMETIC FLEXIBLE CONTAINERS

(75) Inventor: Emilio Tessera Chiesa, Rivoli (IT)

(73) Assignee: Sales S.p.A., Rivoli (Torino) (IT)

( * ) Notice: Subject to any disclaimer, the term of this patent is extended or adjusted under 35 U.S.C. 154(b) by 970 days.

(21) Appl. No.: 11/408,910

(22) Filed: Apr. 21, 2006

(65) Prior Publication Data

US 2006/0257611 A1 Nov. 16, 2006

(30) Foreign Application Priority Data

Apr. 21, 2005 (IT) ..... TO2005A0269

(51) Int. Cl.
*B65D 33/00* (2006.01)
*B65D 33/16* (2006.01)

(52) U.S. Cl. ..... 383/205; 383/206; 383/66

(58) Field of Classification Search ..... 383/203–206, 383/66; 229/87.05, 238, 239
See application file for complete search history.

(56) References Cited

U.S. PATENT DOCUMENTS

| | | | | |
|---|---|---|---|---|
| 2,952,395 | A * | 9/1960 | Spees | 383/205 |
| 3,127,087 | A * | 3/1964 | Spees | 383/205 |
| 3,266,965 | A | 8/1966 | Spees | 156/152 |
| 4,629,071 | A * | 12/1986 | Tani | 383/206 |
| 4,650,079 | A * | 3/1987 | Tani | 383/206 |
| 4,836,378 | A * | 6/1989 | Lephardt | 206/459.5 |
| 4,874,096 | A * | 10/1989 | Tessera-Chiesa | 383/5 |
| 5,836,697 | A | 11/1998 | Chiesa | 383/205 |
| 5,855,435 | A * | 1/1999 | Chiesa | 383/204 |
| 6,461,044 | B1 * | 10/2002 | Anderson | 383/211 |
| 7,093,711 | B2 * | 8/2006 | Draghetti et al. | 206/268 |

FOREIGN PATENT DOCUMENTS

| | | |
|---|---|---|
| EP | 0 758 994 B1 | 7/1998 |
| JP | 09207948 | 8/1997 |
| WO | WO 95/30599 | 11/1995 |
| WO | WO 95/30601 | 11/1995 |
| WO | WO 97/18143 | 5/1997 |

OTHER PUBLICATIONS

European Search Report for EP 06 11 2848.4-2308, dated Aug. 9, 2006.

* cited by examiner

*Primary Examiner*—Jes F Pascua
(74) *Attorney, Agent, or Firm*—Heslin Rothenberg Farley & Mesiti P.C.; Victor A. Cardona, Esq.

(57) ABSTRACT

Described herein is a device for opening hermetic flexible containers, comprising a flexible strip heat-sealed to the internal surface of a wall of the container and incorporating a tape-like thread having a tear tab to cause tearing of the strip, and the consequent tearing of the wall of the container, via a gripping tab of said wall. The gripping tab and tear tab are staggered with respect to one another and hermetically isolated by a heat seal between the strip and the wall of the container.

5 Claims, 5 Drawing Sheets

DEVICE FOR OPENING HERMETIC FLEXIBLE CONTAINERS

CROSS-REFERENCE TO RELATED APPLICATIONS

This application claims priority from Italian Patent Application No. TO2005A000269, filed Apr. 21, 2005, the entire disclosure of which is incorporated herein by reference.

FIELD OF THE INVENTION

The present invention relates to devices for opening flexible containers, particularly bags or sachets for foodstuffs, as well as for products in the form of powder, liquids, and other products.

STATE OF THE PRIOR ART

In particular, the invention constitutes an improvement of the device forming the subject of the Italian patent No. IT-1.273.179, filed in the name of the present applicant, to which there correspond, among others, European patent No. EP-B-758994 and U.S. Pat. No. 5,836,697.

The device described and illustrated in the aforesaid prior patents comprises a flexible strip designed to be applied to the inner surface of a wall of the flexible container and incorporating a tape-like thread extending along a longitudinal area of tearing of the strip. The thread has a tear tab defined by dinking of the strip and designed to enable, in use, pulling of said tear tab by means of a gripping tab, defined by a dinking of the wall of the container, to cause tearing of the strip and consequent tearing of the wall of the container.

In the aforesaid prior patents the strip exemplified consists of an adhesive label. However, in the practical embodiment, it has proven more convenient to make the strip—in an altogether equivalent way—with a heat-sealable material so as to be able to apply it by means of heat sealing to the wall of the container in the case where the latter is also made of heat-sealable material. An application of this sort by means of heat sealing is described and illustrated in the Italian patent No. IT-B-1319964, which is also filed in the name of the present applicant. The strip is heat-sealed to the wall of the container with the exclusion of the area corresponding to the dinking that defines the gripping tab. The dinking astride of the strip that defines the tear tab, following upon its application to the wall of the container, is set in register with the dinking made on the wall of the container or in any case in direct communication with the latter. The communication between the two dinkings would cause a passage of flow between the inside and the outside of the container that might jeopardize the perfect hermetic seal thereof, and in any case would not enable the inside of the container to be kept at a pressure different from atmospheric pressure. This would entail the impossibility of using the opening device according to the aforesaid prior patents effectively in the case where the inside of the container is designed to be kept, prior to its opening, in negative pressure (i.e., in vacuum conditions), or in overpressure.

To solve this problem, the prior patent of the present applicant No. IT-1.273.179 (as has been said, corresponding to the patents Nos. EP-B-758994 and U.S. Pat. No. 5,836,697) proposed two solutions:

a) application of a label on the back of the glued or heat-sealed strip, in a position corresponding to the dinking defining the tear tab, so as to close the passage of flow (FIG. 5); this solution is valid, but deemed excessively complex and burdensome for production purposes;

b) application of the strip by means of gluing or heat sealing on the internal surface of the wall of the container in such a way that the dinking made on said wall does not correspond to the dinking of the underlying strip, i.e., so that the gripping tab of the wall of the container is staggered with respect to the tear tab of the strip, separating these two areas by a totally air-tight heat-sealed surface; this system (exemplified in FIGS. 15 and 16 of the aforesaid previous patent) is perfect as regards its hermetic seal but presents a practical problem linked to the difficulty of opening for the user, who has to overcome the resistance of two relatively wide surfaces that are welded to one another, in order to open the container.

SUMMARY OF THE INVENTION

The object of the present invention is to overcome the above drawback, and this is achieved thanks to the fact that the dinking that defines the tear tab of the strip, which is staggered with respect to the dinking that defines the gripping tab of the wall of the container, is hermetically separated from the latter via an area of localized heat sealing between the strip and the wall of the container.

BRIEF DESCRIPTION OF THE DRAWINGS

The closing device according to the invention, which can moreover be conveniently provided with an adhesive band for re-closing of the container following upon its first opening, will now be described in detail with reference to the annexed plate of drawings, which are provided purely by way of non-limiting example and in which.

DETAILED DESCRIPTION OF THE INVENTION

Figure 1:
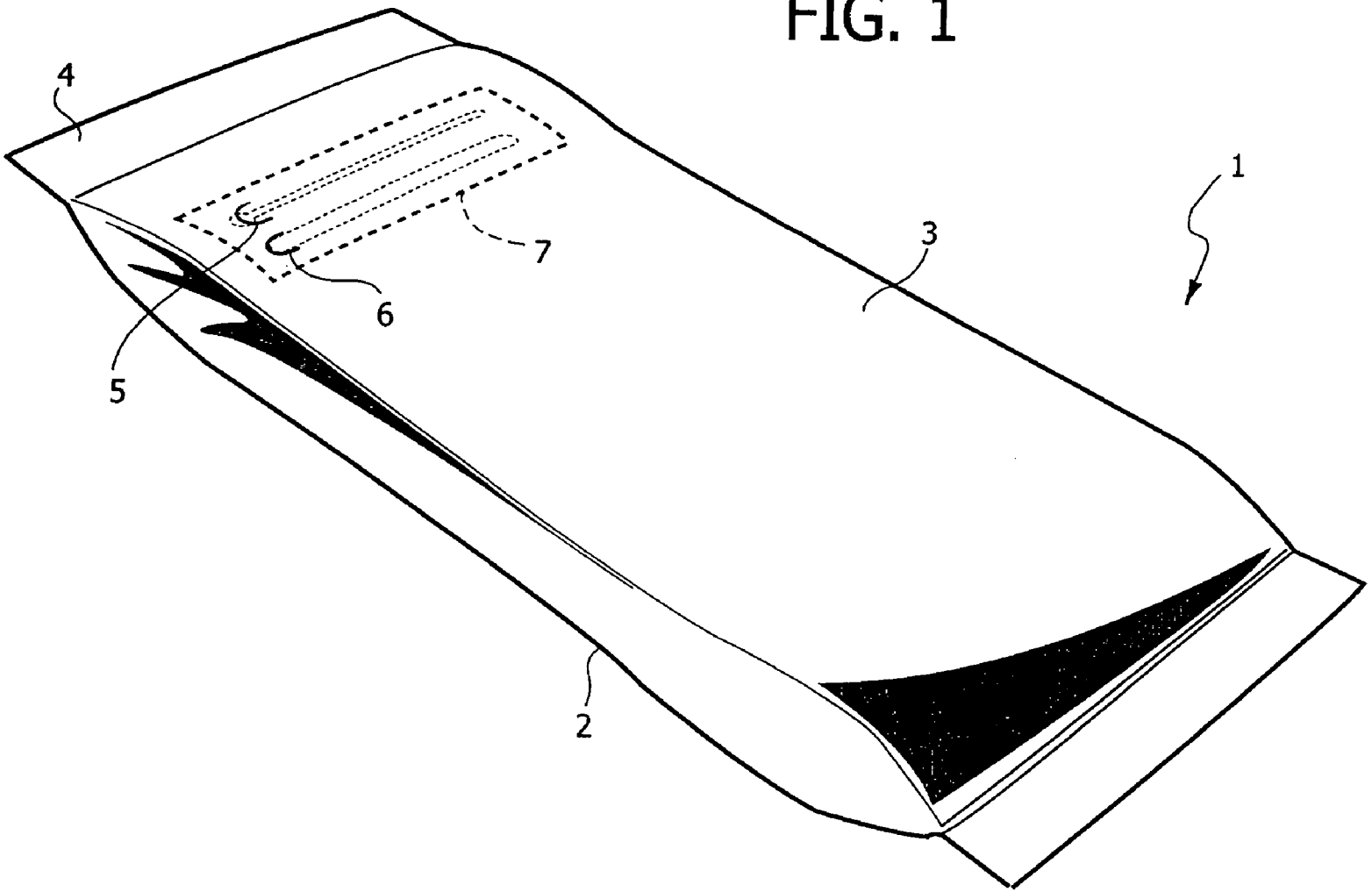
FIG. 1 is a schematic perspective view of a flexible container provided with an opening device according to the invention.

With reference to FIG. 1, designated by 1 is a flexible container constituted, for example, by a bag made of thermoplastic material, plasticized paper or in any case heat-sealable material, designed to contain products of any nature also in vacuum conditions or in overpressure.

The container 1 is formed by two walls 2, 3 joined laterally together and at the ends normally by means of heat sealing.

One of the walls of the container 1, for example the wall 3, is formed in the proximity of one end 4 with a pair of dinkings or notches 5, 6 defining respective gripping tabs, designated by the same reference numbers 5 and 6, the function of which will be described in what follows.

Applied to the internal surface of the wall 3 in a position corresponding to the area of the gripping tabs 5, 6 and in the specific relation with these that will be hereinafter described, is a strip 7 that constitutes an opening (and re-closing) device according to the invention.

Figure 2:
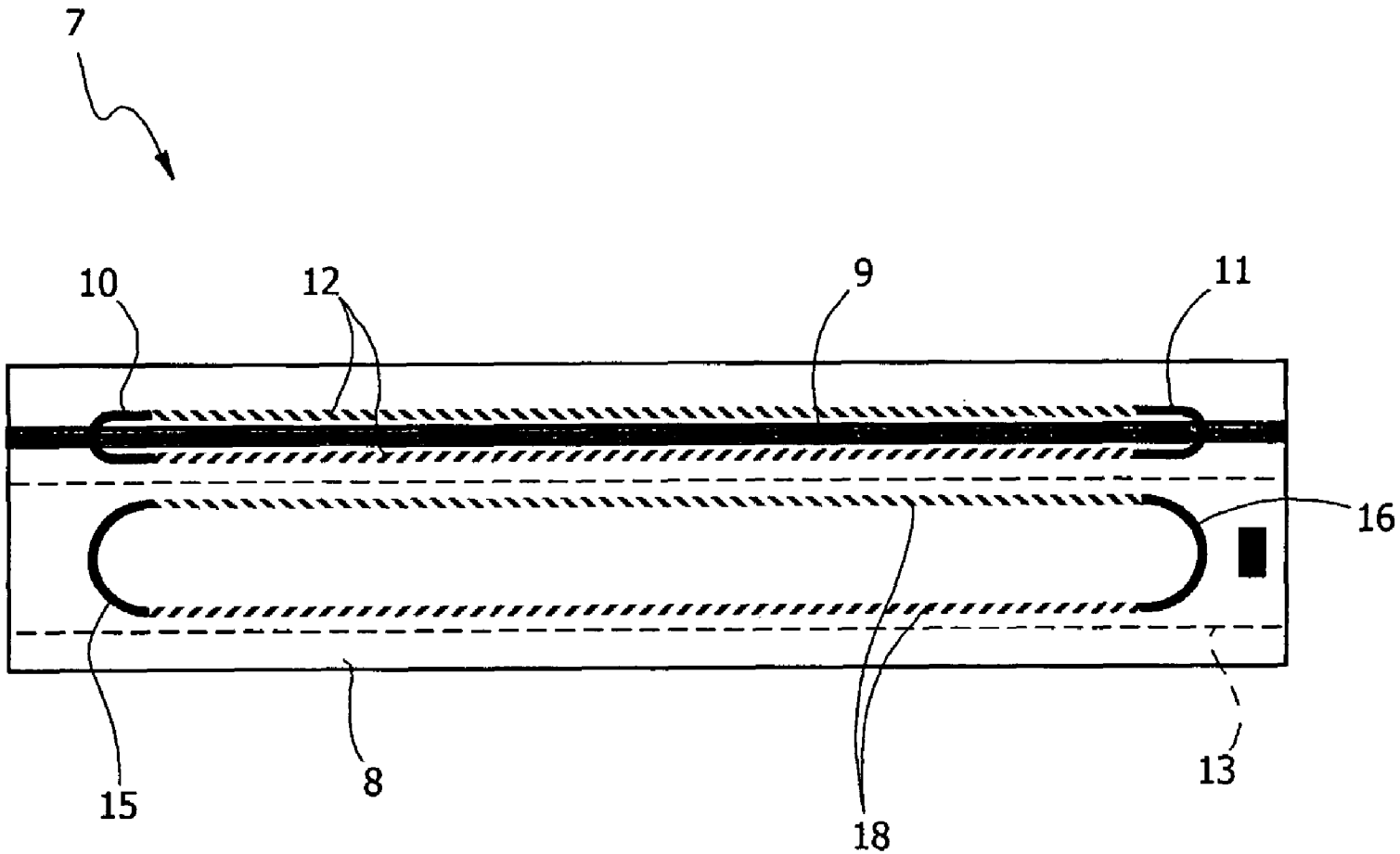
FIG. 2 is a schematic plan view of the strip that constitutes the opening device according to the invention.
Figure 3:
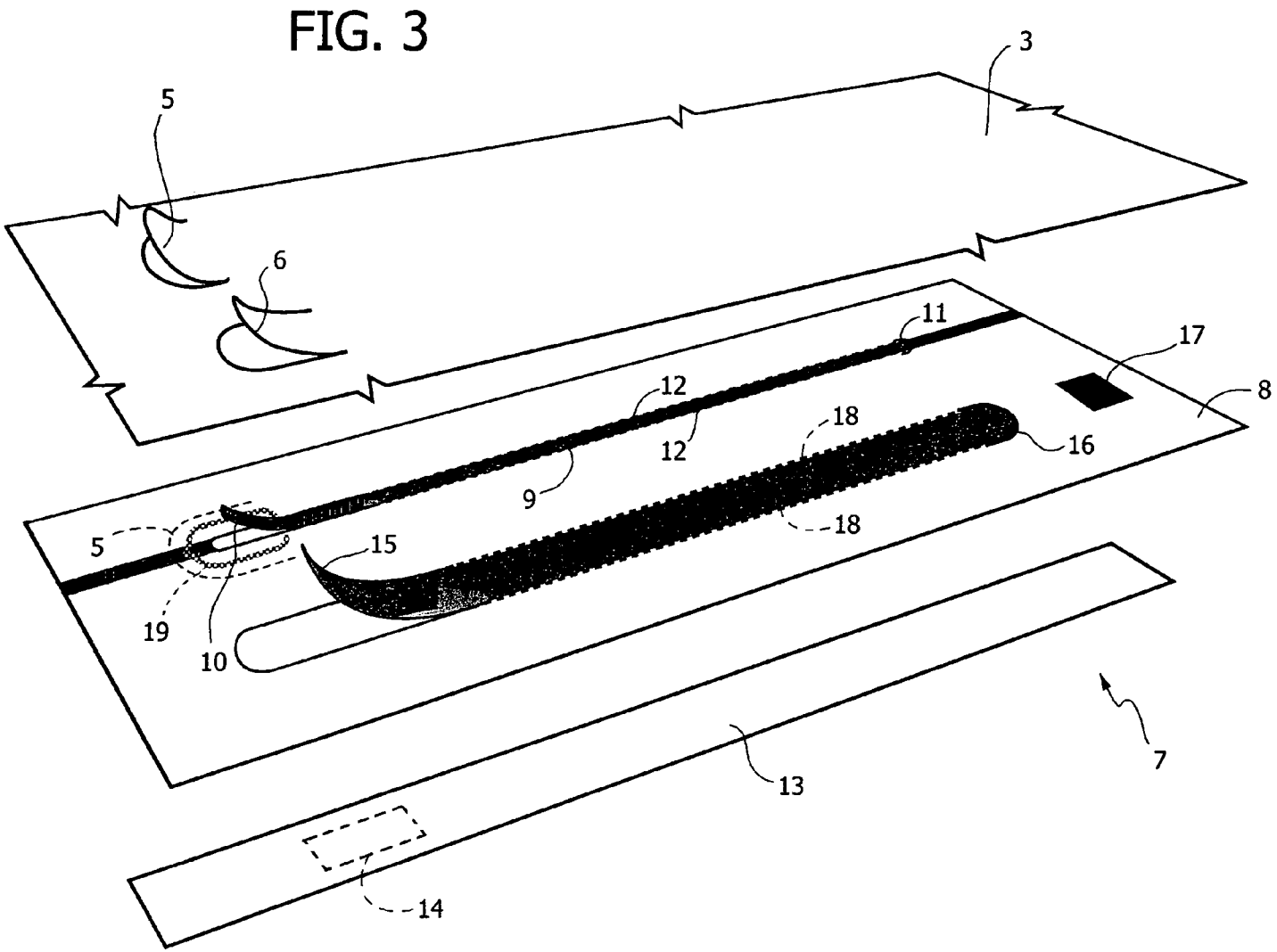
FIG. 3 is a partially exploded perspective view of the flexible container of FIG. 1, which exemplifies operation of the device.

The strip 7 is represented in greater detail in FIGS. 2 and 3: it comprises a support 8, for example having an elongated rectangular shape, made of heat-sealable material, typically polyethylene or polypropylene. A tape-like thread 9 is applied along the top area of the support 8 and extends longitudinally practically throughout the entire length thereof. Astride of, and in the proximity of, the opposite ends of the tape-like thread 9, which can for example be coloured, the support 8 is formed with a generally U-shaped initial dinking 10, which, as will be seen, defines a tear tab, and with a terminal dinking 11, which is also generally U-shaped. Formed in the support 8 between the dinkings 10 and 11 are two longitudinal lines of preferential tearing 12, constituted for example by stretches of dinking.

Applied underneath the bottom area of the support 8 is a self-adhesive longitudinal band 13, possibly with the interposition of an intermediate tape-like thread (not illustrated), which is not, however, particularly necessary. In the case where said intermediate thread were not provided, as in the case of the example illustrated, the self-adhesive band 13 is formed with an area 14 that is rendered non-adhesive, constituted, for example, by a siliconized portion printed on the adhesive, the function of which will also be clarified in what follows.

In the proximity of the end of the self-adhesive band 13, the support 8 of the strip 7 is formed with a generally U-shaped initial dinking 15 and a terminal dinking 16, which is also generally U-shaped, of which the former, set in a position corresponding to the non-adhesive area 14, constitutes—as will be seen in what follows—a second gripping tab.

The support 8 can moreover bear a printed mark 17, which can be used for mechanized application of the strip 7 to the container 1, for example according to the modalities described in the already cited Italian patent No. IT-B-1319964, or else a possible indicator, constituted for example by a magnetic element, a transducer or a microchip (designated as a whole by the same reference number 17), designed to co-operate functionally in a known way with any conventional anti-shoplifting device, with which sales outlets for the sale of the products packaged within the container 1 can usually be provided. The indicator 17 will hence be applied to the container 1 upon application of the strip 7 and will consequently be enclosed inside it, thus being not only invisible but also inviolable from outside.

Also formed between the dinkings 15 and 16 are two longitudinal lines of preferential tearing 18 constituted, as in the case of the lines of preferential tearing 12, by stretches of dinking formed in the support 8.

The tear tab 10 associated to the tape-like thread 9 has the function of causing, following upon pulling thereof towards the outside of the strip 7, tearing of the thread 9 along the lines of preferential tearing 12 as far as the terminal dinking 11, so as to form a longitudinal opening through the support 8 and hence along the strip 7.

The tear tab 15 has instead the function, when subjected to pulling towards the outside of the strip 7, of producing, along the lines of preferential tearing 18 and as far as the terminal dinking 16, a window along the support 8 in such a way as to expose, towards the outside of the container 1, the portion of the adhesive band 13 delimited by said window. The non-adhesive area 14 has the function of freeing the gripping tab 15 from the adhesive surface of the band 13.

As mentioned previously, the strip 7 thus described is heat-sealed to the internal surface of the wall 3 in a position corresponding to the area of this in which the gripping tabs 5 and 6 are formed. In the case where the aforementioned intermediate tape-like thread is provided, the tear tab 15 is located substantially in a position precisely corresponding to the gripping tab 6. Otherwise, the relative arrangement may correspond substantially to the one described hereinafter regarding the gripping tab 5 and the tear tab 10.

Figure 5:
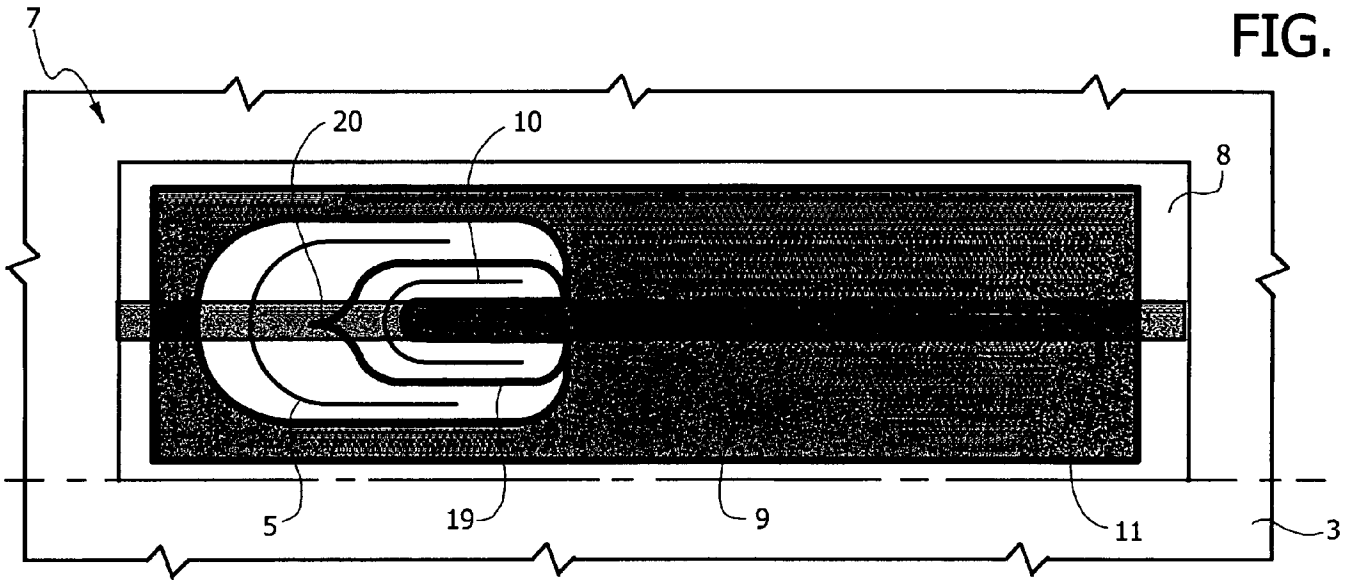
FIG. 5 shows a part of the strip that constitutes the opening device according to the invention following upon its heat sealing to the wall of the container.

The dinking that defines the line of start of the tear tab 10 is positioned so that it is staggered with respect to the gripping tab 5. This is because, as explained at the start, if the corresponding dinkings were to be set in register with one another, there would be created a passage of flow between the inside of the container and the atmosphere that would jeopardize the tightness of the container in the case where the inside of the container is to be set in vacuum conditions or under pressure. The relative positioning between the gripping tab 5 and the tear tab 10 is represented in FIG. 5. As may be seen, the gripping tab 5 is displaced with respect to the tear tab 10 on the side opposite to the terminal dinking 11, i.e., in a direction opposite to the direction of tearing of the thread 9. To enable the gripping tab 5 to be gripped from outside of the container 1 and then tugged to enable pulling of the tear tab 10 and hence, via the tearing of the thread 9, tearing of the strip 7 and the corresponding tearing of the wall 3, said gripping tab 5 must evidently not be heat-sealed to the strip 7. To prevent communication between the two dinkings corresponding to the tabs 5 and 10, the invention envisages a particular system of heat sealing; namely, the dinkings corresponding to the two tabs 5 and 10 are hermetically separated from one another via a heat seal between the strip 7 and the wall 3 of the container, which can be readily removed upon initial opening of the device.

The area of heat sealing can be made according to different alternatives. In the case represented in FIG. 5, the area of heat sealing consists of a substantially annular localized thin line 19 surrounding the tear tab 10, astride of the tape-like thread 9, and conveniently has a nick 20 for facilitating tearing facing the gripping tab 5, for example a cusp-shaped nick.

Figure 4:
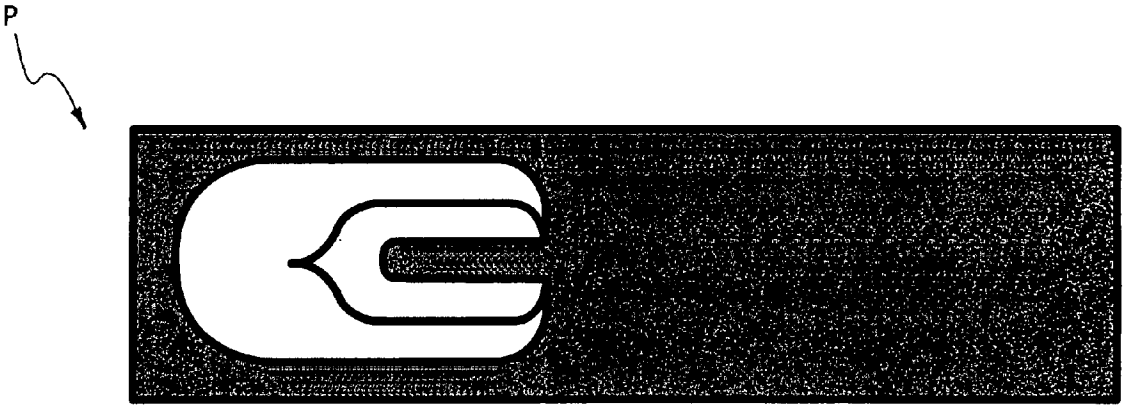
FIG. 4 is a schematic illustration of the conformation of a part of a plate for heat sealing that can be used for application to the container of the opening device according to the invention.

FIG. 4 is a schematic illustration of the conformation of a heat-sealing plate P suitable for forming said heat-sealing profile 19 simultaneously with heat sealing of the top area of the strip 7, or of the area corresponding to the thread 9, as has been said with exclusion of the gripping tab 5 and tear tab 10.

Figure 6:
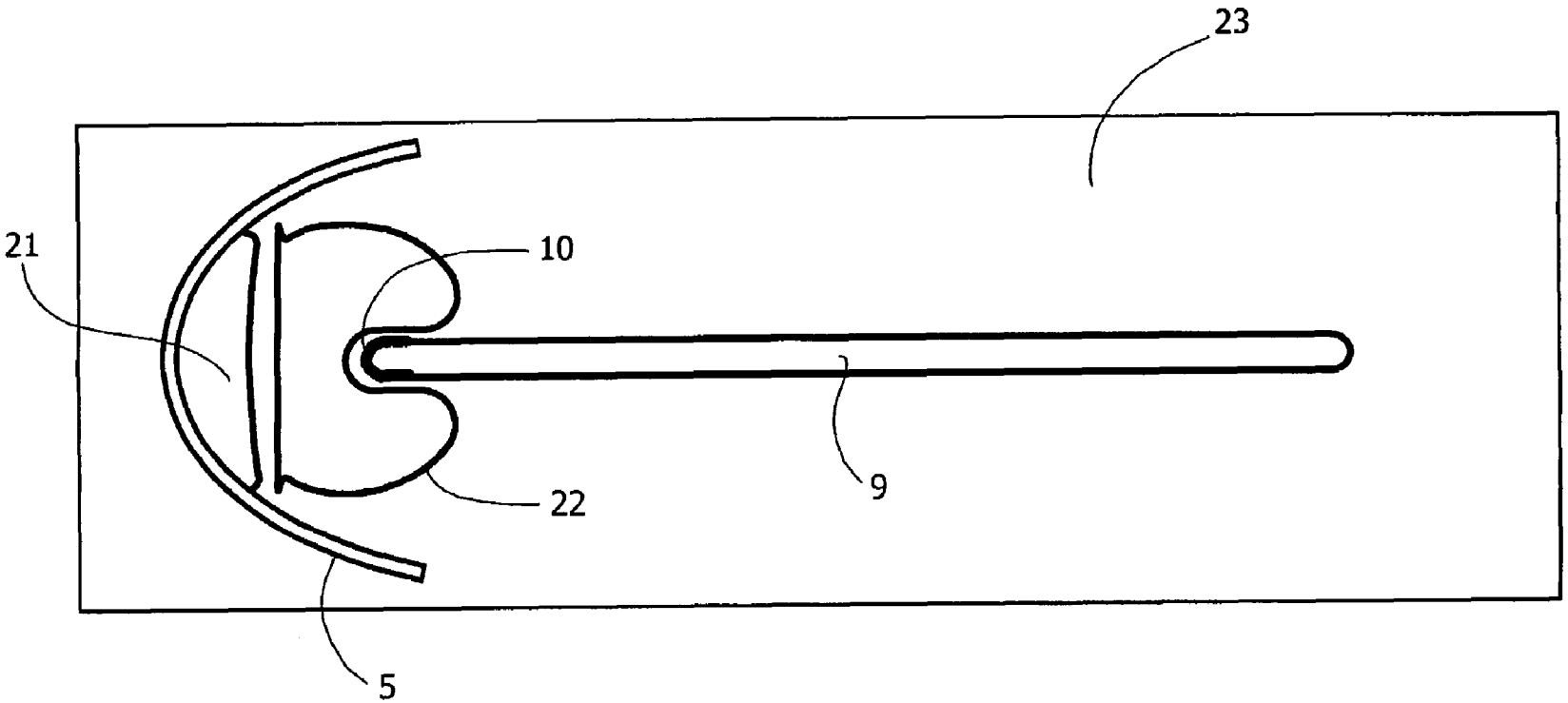
FIG. 6 shows a variant of FIG. 5.

An alternative solution for hermetically isolating the two dinkings corresponding to the tabs 5 and 10 from one another is represented schematically in FIG. 6. Provided within the dinking 5 of the wall 3 of the container 1 is an area that is not heat-sealed 21, which constitutes the gripping tab proper, whilst the dinking 10 astride of the thread 9 of the strip 7 is delimited by an area that is not not heat-sealed 22, which has the particular conformation illustrated and is provided for facilitating tearing towards the dinking 10. The hermetic seal is in this case guaranteed by a widened area of heat sealing 23.

The modalities of opening and subsequent re-closing of the container 3 obtained through the heat-sealed strip 7 will emerge clearly from the foregoing description. To obtain initial opening, the gripping tab 5 is gripped manually and pulled towards the outside of the container 1. Said action produces convenient tearing of the heat-sealed area 19 (or respectively 23) and the subsequent pulling of the tear tab 10, and hence of the thread 9, as far as the terminal dinking 11. The inside of the container 1 is thus accessible from outside through the slit originated by tearing of the thread 9 through the strip 7 and the wall 3.

To re-close (obviously not hermetically) the container 1, it is sufficient to grip the gripping tab 6 and pull it towards the outside, pulling the tear tab 15 as far as the terminal dinking

16 of the strip 7, so as to expose the self-adhesive band 13 against which the end 4 of the container 1, folded over the opening generated by tearing of the thread 9, may then be made to adhere.

Of course, the details of construction and the embodiments may vary widely with respect to what is described and illustrated herein, without thereby departing from the scope of the present invention, as defined in the ensuing claims.

What is claimed is:

1. A device for opening hermetic flexible containers, comprising:

a flexible strip configured to be applied to an internal surface of a wall of a container, said strip comprising:

a tape-like thread extending along a longitudinal area of tearing of the strip;

a tear tab defined by a dinking of the strip configured to enable, in use, pulling of said tear tab by means of a gripping tab defined by a cut of said wall of the container, said tear tab configured to cause tearing of the strip and the consequent controlled tearing of said wall of the container;

said strip and said wall of the container made of heat-sealable material and heat-sealed to one another, with the exclusion of said gripping tab;

the dinking that defines the tear tab of the strip staggered with respect to the dinking that defines the gripping tab of the wall of the container, wherein the dinking that defines said tear tab of the strip is hermetically separated from the dinking that defines said gripping tab of the wall of the container via an area of heat sealing between said strip and said wall of the container; and wherein said area of heat sealing is defined by a thin, substantially annular, localized heat-sealed line.

2. The device according to claim 1, wherein said area of heat sealing is coupled to said gripping tab, said area of heat sealing shaped so as to define a nick to facilitate tearing of said area of heat sealing when said gripping tab is pulled.

3. The device according to claim 1, wherein said strip further comprises an adhesive band parallel to, and at a distance from, said tape-like thread, facing said wall of the container and extending underneath a further longitudinal area of tearing of said strip starting from a second tear tab of said strip corresponding to a second gripping tab of the wall of the container.

4. The opening device according to claim 1, wherein said strip incorporates an indicator for anti-shoplifting devices.

5. A hermetic flexible container, incorporating an opening device according to claim 1.

* * * * *